US005199824A

United States Patent [19]

Smith et al.

[11] Patent Number: 5,199,824

[45] Date of Patent: Apr. 6, 1993

[54] EXCAVATION SHORING SYSTEM

[76] Inventors: Jeffrey F. M. Smith, 82 Reynolds Mill Rd., York, Pa. 17403; Vincent T. Rice, 3361 W. Canal Rd., Dover, Pa. 17315

[21] Appl. No.: 923,519

[22] Filed: Aug. 3, 1992

[51] Int. Cl.[5] ..... E21D 5/12; E02D 17/00

[52] U.S. Cl. ..... 405/282; 405/272; 405/281

[58] Field of Search ..... 405/282, 283, 281, 272, 405/273

[56] References Cited

U.S. PATENT DOCUMENTS

| | | | |
|---|---|---|---|
| 2,246,623 | 6/1941 | Dorey . | |
| 3,335,573 | 8/1967 | Ward | 405/282 |
| 3,729,938 | 5/1973 | Morrice | 405/282 |
| 3,782,125 | 1/1974 | Holl | 405/282 |
| 4,376,599 | 3/1983 | Krings | 405/282 |
| 4,487,530 | 12/1984 | Morrice | 405/282 |
| 4,685,837 | 8/1987 | Cicanese . | |

FOREIGN PATENT DOCUMENTS

| | | | |
|---|---|---|---|
| 1251243 | 9/1967 | Fed. Rep. of Germany | 405/282 |

OTHER PUBLICATIONS

Pit Excavation System Brochure, Krings Construction Systems, Bridgewater, N.J.

*Primary Examiner*—Dennis L. Taylor
*Attorney, Agent, or Firm*—Samuel M. Learned, Jr.

[57] ABSTRACT

An excavation shoring system comprised of a modular support frame having longitudinal and lateral beam members provided with collar sleeve openings adapted to slidably receive vertical support pipes which in turn are provided with regularly spaced vertical openings for insertably receiving stop pins in setting vertical height adjustment retention of the longitudinal and lateral beam members of the support frame to accommodate an excavation pit depth when assembling the support frame for placement use in vertically holding shoring grids to retain the exposed earthen walls of an open pit, which shoring grids are in turn adapted to receive slidably inserted planks within the grid slot structure thereof in further providing additional retentive support for unstable soils.

7 Claims, 7 Drawing Sheets

EXCAVATION SHORING SYSTEM

BACKGROUND OF THE INVENTION

The present invention, subject of Disclosure Document No. 299257 which was filed on Jan. 13, 1992, relates to an excavation shoring system for use in excavation depressions such as construction pits and trenches, as well as cuts in sloped earthen banks, to provide worker safety from the hazard of cave in while occupying and working within the excavated depression or cut.

One of the current construction practices in traversing an established roadway with an underground pipe, conduit, cable or the like is to tunnel under the roadway rather than cut, trench, fill and repair thereby preserving the structural integrity of the road bed and surface and not shutting down use of the roadway during construction operations. If the roadway underground crossing site is located on flat terrain then it is necessary to prepare an excavation depression or pit on either side thereof and tunnel underneath. If the roadway is on an elevated earthen bed then tunneling may be accomplished directly therethrough. In either event, however, with the use of power boring and drilling equipment within an excavated depression or within a cut at an earthen slope, and for purposes of general worker safety, it is prudent if not necessary to provide shoring support for the excavation walls or sides of a sloped cut to reduce the danger from cave in.

The prior art shows various shoring systems of modular component assembly, typical of which are those respectively taught in U.S. Pat. No. 4,685,837 to Cicanese dated Aug. 11, 1987, and as shown in the Pit Excavation System brochure of Krings Construction systems of Bridgewater, N.J., both of which have solid side shoring panels and require heavy lifting and rigging equipment to accomplish erection and installation.

An additional feature of the applicant's excavation shoring system invention is that it employs the use of a grid type side shoring panel which itself is suitable for supporting many types of soils, and is adapted to slidably receive planks for providing increased shoring support with less stable soils. The shoring grid feature enables two advantages not realized by the foregoing teachings. First, the overall shoring system is lighter since solid sheet steel side panel members are not used and it can be installed and removed with lighter equipment and second the relatively open grid system to the extent it is not necessary to be planked allows for better visibility into the shored excavation depression when installing and removing men and material and equipment, which is an enhanced safety feature.

A prior art teaching which does show a slotted plank earth shoring system is that by Dorey in U.S. Pat. No. 2,246,623 dated Jun. 24, 1941, for a knockdown cribbing assembly for graves, which is both structurally and functionally distinguished from applicant's teaching, however, in that the shoring planks are not slidably installed only to the height needed and thereby no enhanced visibility feature is achieved.

Applicant's excavation shoring system invention, in both the preferred and alternate embodiment forms thereof, provides in each case individually and interchangeably, new and novel systems and apparatus for the safe and efficient flexibly adaptable shoring of both excavation depressions and sides of cuts in sloped earthen banks to provide worker and equipment protection against cave in.

SUMMARY OF THE INVENTION

It is the principal object of the present invention to provide an excavation shoring system which is assembled from modular components at surface level, and installed from the surface level, so that personnel are not required to be below ground until after the system is installed and the excavation depression is safely shored.

It is another object of the present invention to provide an excavation shoring system that enables maximum surface level visibility into an excavated depression, consistent with the safe shoring thereof, during the lowering and placement of equipment and material therein.

An additional object of the present invention is to provide an excavation shoring system that can be erected and installed at a job site location without the need for heavy rigging equipment.

It is also an object of the present invention to provide an excavation shoring system that is simple and rugged in both design and construction, is reusable, and has interchangeable modular components to provide maximum flexibility in adapting the use thereof for shoring in any kind of open static excavation environment.

It is a further object of the present invention to provide an excavation shoring system which is adapted to shore pits and trenches, or in an alternate assembly embodiment thereof provide shoring support for cuts in a sloped earthen bank.

It is yet another object of the present invention to provide an excavation shoring system which is easy to assemble and install, and use with safety and convenience.

The foregoing, and other objects hereof, will be readily evident upon a study of the following specification and accompanying drawings comprising a part thereof.

DETAILED DESCRIPTION OF THE INVENTION

Figure 1:
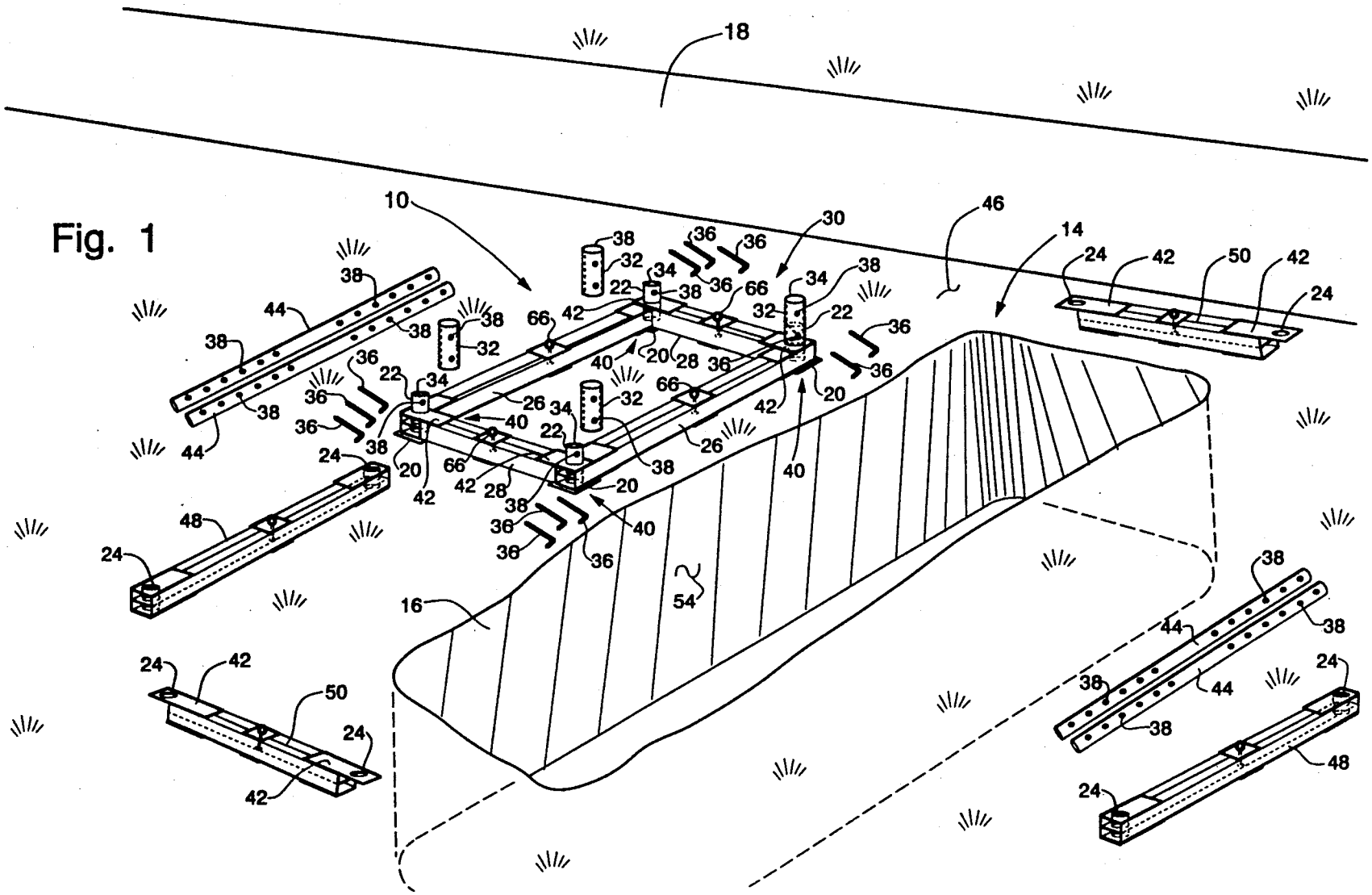
FIG. 1 is a surface level perspective view of a partially assembled modular supporting frame component of the excavation shoring system comprising the instant invention as the same would typically appear at an exemplary excavation depression use installation site.

Referring to FIG. 1, a partially assembled modular support frame assembly 10 of the excavation shoring system 12 of instant invention is shown as the same would typically appear prepatory to the erection thereof at an exemplary use installation site 14, which in this case is illustrated as an excavation pit 16 prepared in a relatively flat terrain profile adjacent to a roadway 18 for purposes of tunneling thereunder to install an underground conduit or the like, wherein the component parts comprising the modular support frame assembly 10 are a set of four support feet 20 to each of which is affixed as an integral part thereof a centrally positioned upward projecting base post 22 being adapted to insertably engage and structurally support by collar plate openings 24 respectively provided therein at the opposing ends thereof a pair of support frame lower longitudinal beams 26 and a pair of support frame lower lateral beams 28. Once the lower longitudinal and lateral beams 26 and 28 are insertably assembled to the base posts 22 as shown in FIG. 1, which sub-assembly provides the modular support frame base 30, then post connecting sleeves 32 are respectively slidably assembled to the upward projecting ends 34 of the base posts 22 and then by means of inserting a connecting pin 36 through aligned cooperative pin openings 38 respectively in the upward projecting end 34 of the base posts 22 and the lower end of the connecting sleeve 32, which thereby locks the respective corners 40 of the modular support frame base 30 between the upper surface of the support feet 20 and said connecting pin 36 so the modular support frame base 30 may be mechanically lifted and positioned in the excavation pit 16 for continued assembly and completed erection of the modular support frame assembly 10. Additional components of the modular support frame assembly 10 as shown in FIG. 1 are the vertical frame posts 44 which are manually assembled insertably into the four corner 40 post connecting sleeves 32 from the surface level 46 once the assembled modular support frame base 30 has been mechanically lowered into installed position in the excavation pit 16, as shown in FIGS. 2 and 3 and will hereinafter be more fully explained, following which the upper longitudinal beams 48 and the upper lateral beams 50 are thereafter successively installed upon the upward projecting vertical frame posts 44, also from surface level 46, which then completes the assembly and operational erection of a single modular support frame assembly 10 unit of the excavation shoring system 12.

It will additionally be noted, as best shown by the unassembled upper lateral beams 50 illustrated in FIG. 1, but which also applies to the lower lateral beam 2B structures, that the collar plates 42 weldably affixed to the lateral end upward surfaces respectively thereof extend beyond the beam 28 and 50 ends by an amount which is equivalent to the thickness of the longitudinal beams 26 and 48 so that there is a recessed fitting of the longitudinal beams 26 and 48 to the lateral beams 28 and 50 as is best shown by the assembled modular support frame base 30 as also seen in FIG. 1 and certain subsequent Figures hereinafter. The recessed beam fitting feature as above described enables a more compact and rigid modular support frame assembly 10.

Two advantageous features obtained in use of the excavation shoring system 12 hereof are first, the assembly and installation of the system 12 and component parts thereof is achievable with the use of commonly available construction site equipment such as a back hoe and does not require the use of heavy duty rigging equipment such as cranes and the like and second, no personnel are required in the excavation pit 16 until the system 12 is operationally installed since completion of assembly is accomplished from the surface level 46.

Figure 2:
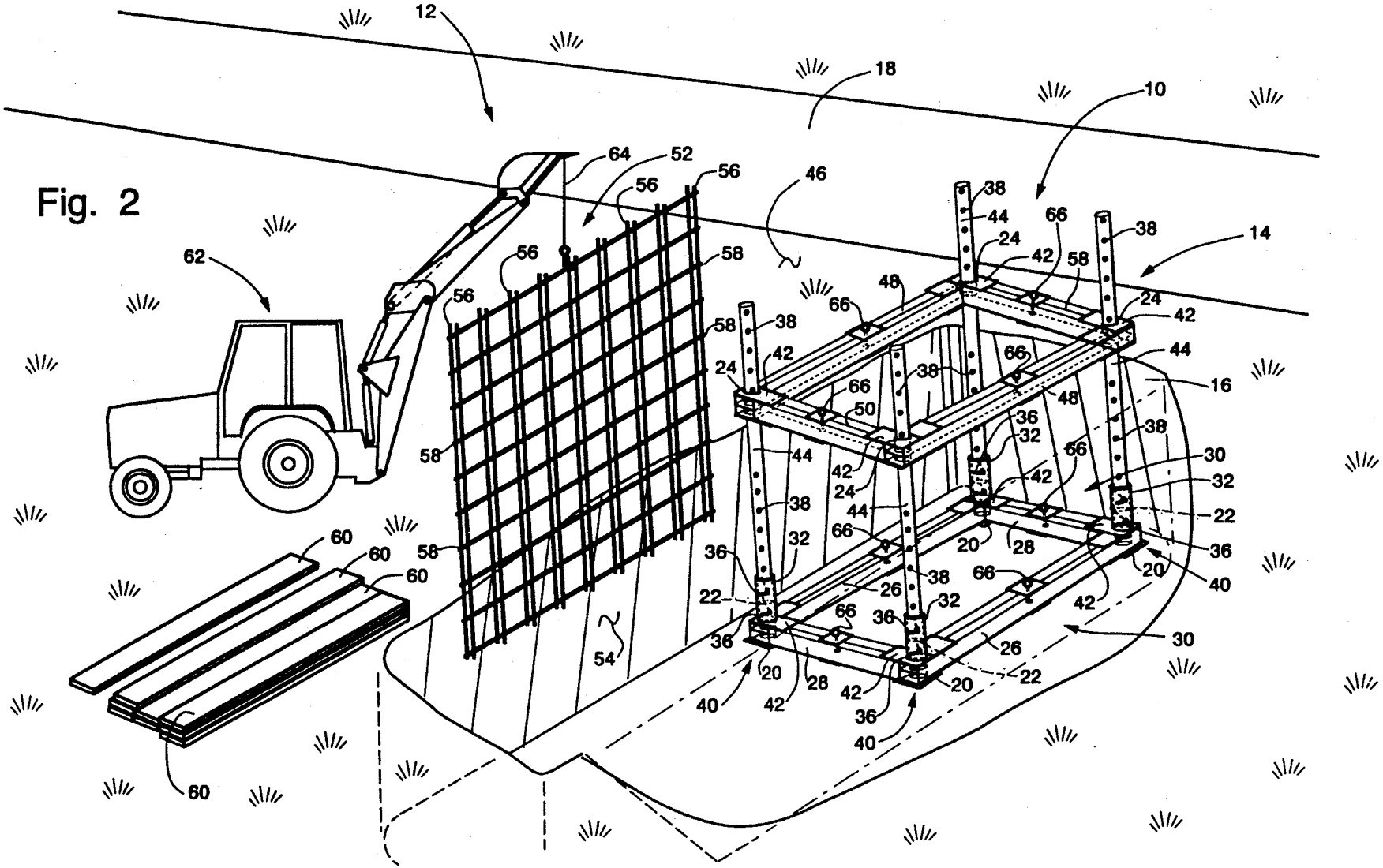
FIG. 2 is a perspective view similar to that as shown in FIG. 1, further illustrating completed assembly erection and installation of the excavation shoring system modular supporting frame component within the excavated depression.
Figure 3:
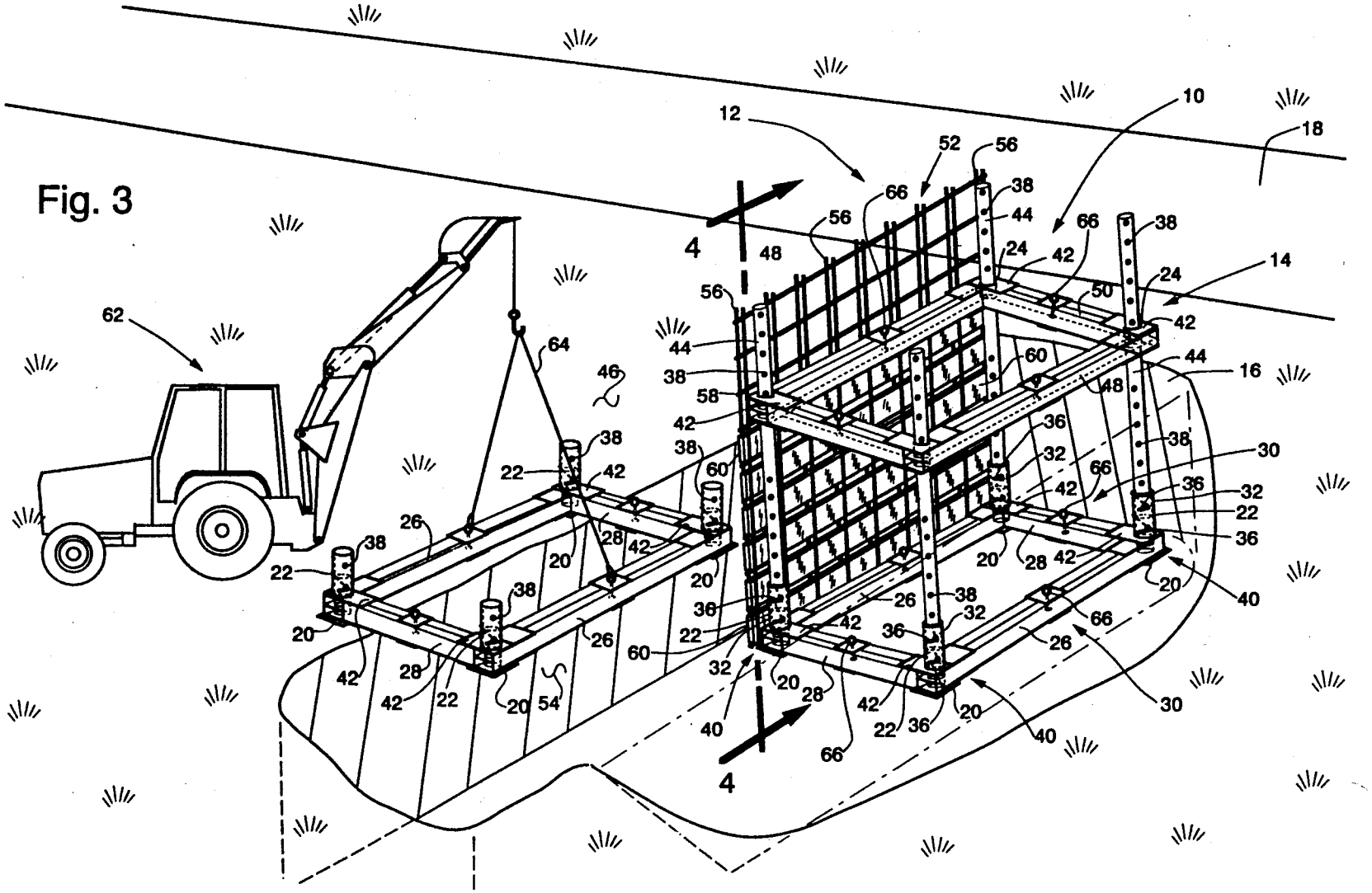
FIG. 3 is a perspective view similar to that as shown in FIG. 2, further illustrating the progressive erection and installation of the excavation shoring system of instant invention within the excavation depression.

Considering now FIG. 2, which shows a modular support frame assembly 10 fully erected and installed in operational use position within the excavation pit 16, having been put together in the manner as previously described. Once the frame assembly 10 is thus positioned, then a shoring grid 52 is mechanically lowered into position in the excavation pit 16 between the pit wall 54 and one of the lateral side vertical profiles of the modular support frame assembly 10. As shown, the shoring grid 52 is a relatively open structured panel weldably fabricated from rod material such as steel reinforcing bar of an appropriate size, formed to provide a pattern of spaced pairs of vertical bars 56 joined to either side of an interiorly spaced plurality of single horizontal bars 58 in such a manner as to thereby form a stacked elongated pocket structure for slidably receiving and supportably holding inserted shoring planks 60, whereby mechanical handling of the shoring grid 52 for moving and positioning is accomplished by relative ease with a back hoe 62 and cable connection 64, also as shown in FIG. 2.

In many shoring applications use of the shoring grid 52 in combination with the erected modular support frame assembly 10 is sufficient to provide adequate and safe pit wall 54 shoring support. In the case of less stable soil conditions, however, an additional use of the shoring planks 60 installed within the shoring grid 52 elongated pocket structure as shown in FIG. 3, to that height necessary and appropriate, provides the required pit wall 54 shoring support for whatever soil stability conditions may be encountered.

Considering now in greater detail the illustration shown in FIG. 3, which is of the partially installed and operationally erected excavation shoring system 12 of instant invention with one modular support frame assembly 10 fully installed in support of a single planked shoring grid 52 and the assembled modular support frame base 30 for a second such assembly 10 being mechanically lowered by means of a back hoe 62 and cable connection 64 for positioning and adjacent installation within the excavation pit 16. In the foregoing respect it should be noted that the excavation shoring system 12, because of the modular assembly nature thereof in accommodating the same to excavation pits 16 of varying sizes and shapes, as well as the nature of the work to be performed, may be comprised of but a single modular support frame assembly 10 with complementary shoring grids 52 and shoring planks 60, or a plurality of such modular support frame assemblies 10 with complementary shoring grids 52 and shoring planks 60 as necessary, and the showing of two such units in the installation and erection profiles as depicted is to be considered as exemplary only and not restrictive. As also shown in FIG. 3, both the lower and upper longitudinal beams 26 and 4B as well as the lower and upper lateral beams 28 and 50 are respectively provided with cable connecting eye bolts 66 to facilitate assembling cable connection 64 thereto for mechanical movement and positioning of the various excavation shoring system 12 component pieces and sub-assembly units.

Figure 4:
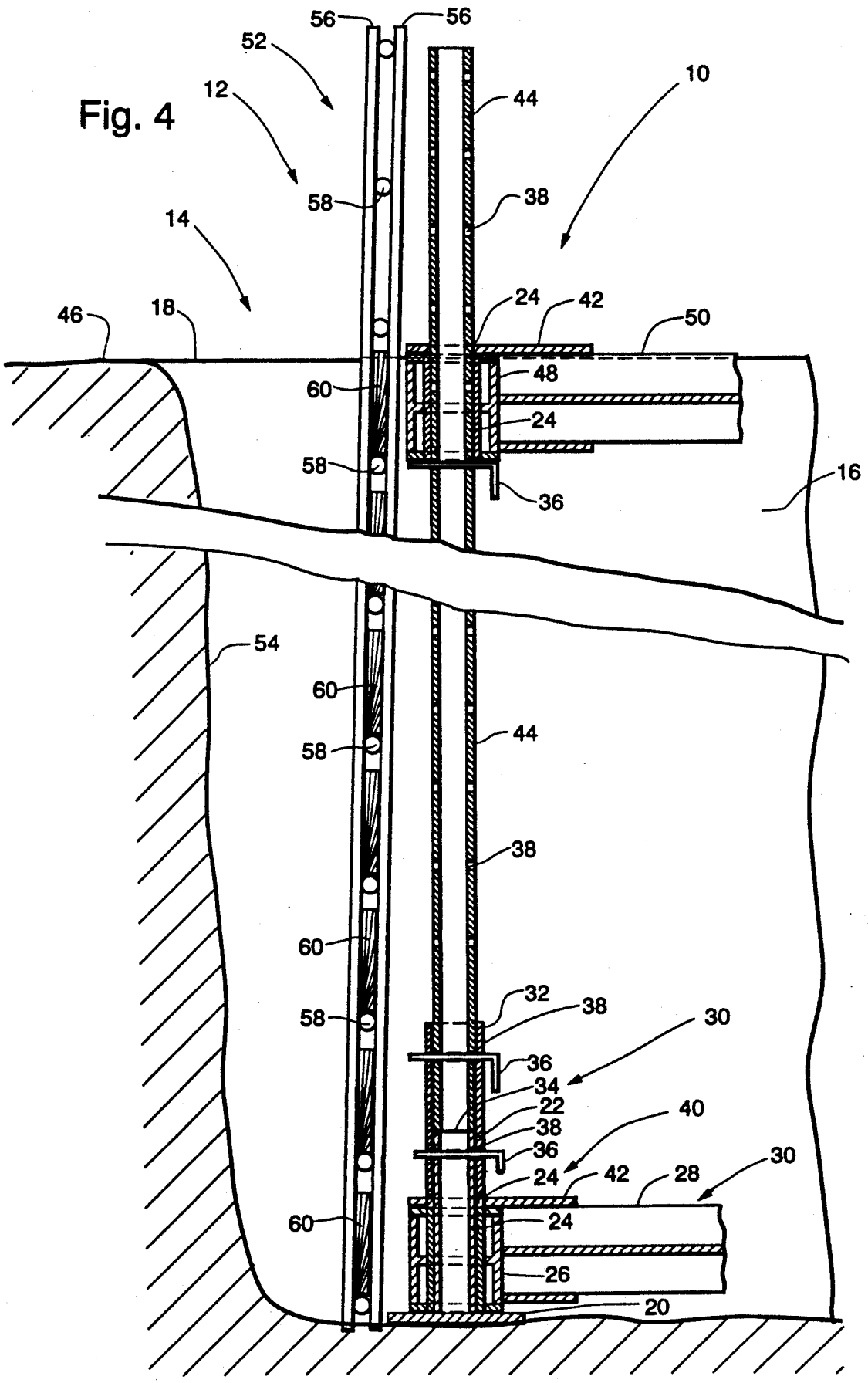
FIG. 4 is an enlarged end elevation view of the erected and installed excavation shoring system assembly as shown in FIG. 3 and seen along the line 3—3 thereof, being foreshortened to accommodate the view to the sheet.

Considering now FIG. 4, being an enlarged end elevation view of the erected and installed excavation shoring system 12 assembly in an operable pit wall 54 shoring profile, wherein shoring planks 60 have been insertably installed within shoring grid elongated pockets 6B to provide additional shoring support as was previously described. In the event use of shoring planks 60 is deemed prudent or necessary to provide additional support capability to the shoring grid 52, the height to which such planks 60 are installed is to that height appropriate for providing the additional protection sought and may be part way up the pit wall 54, or all the way up as illustrated in FIG. 4. The advantage, however, of using only the shoring grid 52 alone when planks 60 are not required, or using planks 60 only to the height necessary, is that surface level 46 observation through the open shoring grid 52 mesh into the pit 16 is thereby relatively unobstructed, which is a safety consideration and feature of the instant invention when personnel are occupying the shored excavation pit 16 during placement of equipment and material therein. Also shown in greater detail in FIG. 4 is the lateral beam 28 and 50 collar plate 42 recessed longitudinal beam fitting feature as previously described on consideration of FIG. 1.

Figure 5:
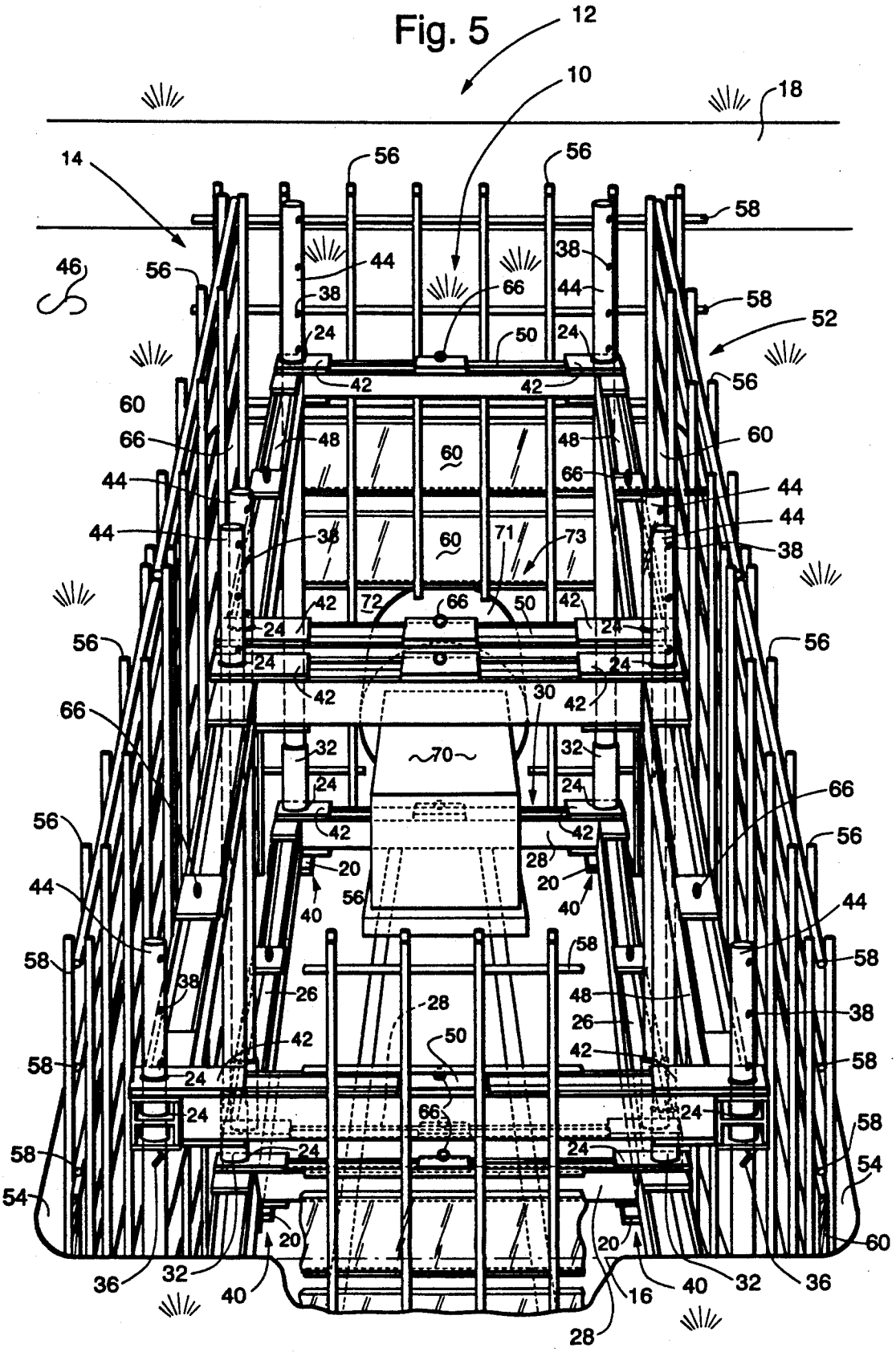
FIG. 5 is an enlarged end perspective elevation view of the excavation shoring system of instant invention as the same would typically appear when fully erected in a use installation configuration within the exemplary excavated depression.

Turning attention now to the end perspective view of FIG. 5 showing the excavation shoring system 12 fully erected in a typical use installation configuration within the excavation pit 16, with a piece of boring machine equipment 70 positioned in the pit 16 for use in tunneling a conduit opening beneath the roadway 18. As shown in FIG. 5, and as is customary in use application of the excavation shoring system 12 hereof, the pit wall working face 72 is also shored in order to thereby provide facilitated equipment access thereto with safety from pit wall cave in hazard, wherein an equipment passage opening 73 is cut in the shoring grid 52 in order in this case to pass the auger head 71 of the boring machine 70. Following job completion the equipment passage opening 73 in the shoring grid 52 may be closed by rewelding in lengths of vertical and horizontal bars 56 and 58 as appropriate.

Figure 6:
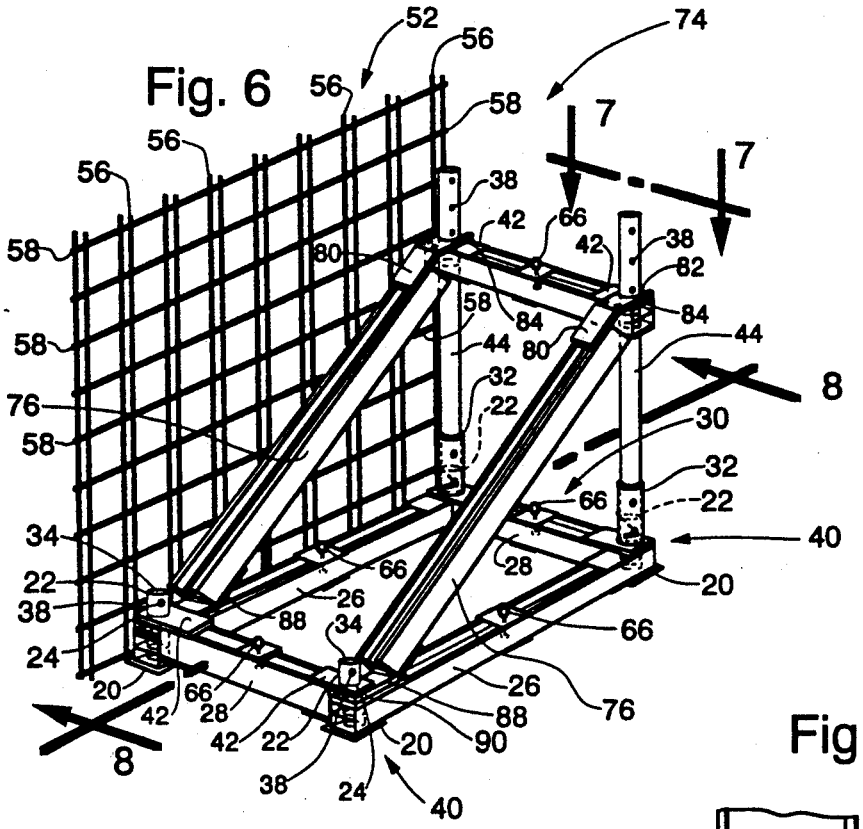
FIG. 6 is a perspective elevation view of the sloped earthen bank alternative assembly embodiment of the excavation shoring system of instant invention.

The view shown in FIG. 6 is that of the sloped earthen bank shoring system 74 alternate assembly embodiment of the instant invention, and utilizes the basic structural components of the excavation shoring system 12, along with some additional modified components such as the angled support beams 76, to provide a support system particularly well adapted to shoring sloped earthen banks such as roadway or railway embankments and the like when boring, cutting or tunneling conduit passages thereunder.

Figure 7:
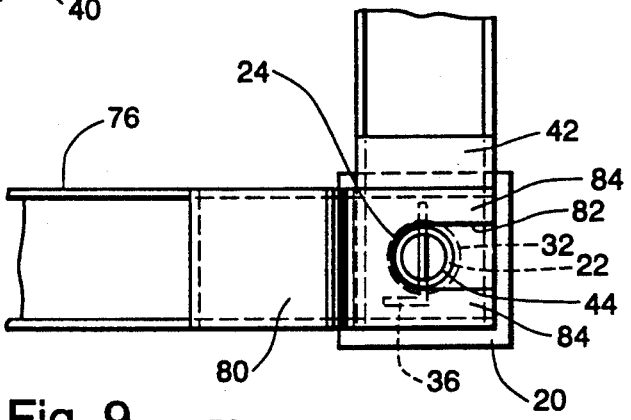
FIG. 7 is an enlarged top plan view of the modular support frame beam-to-post assembly, as shown in FIG. 6 and seen along the line 7—7 thereof.
Figure 8:
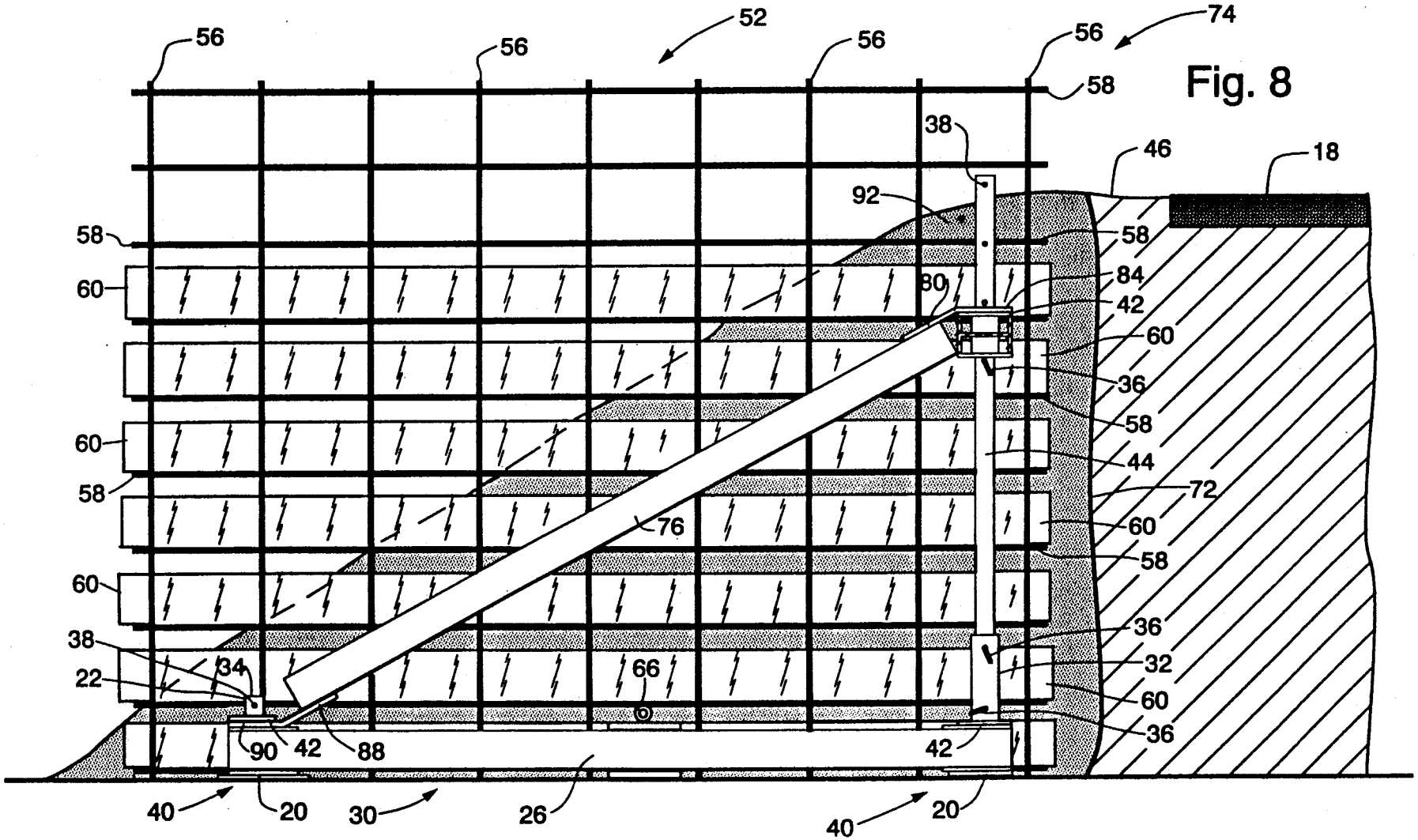
FIG. 8 is an enlarged side elevation use employment installation view of the excavation shoring system sloped earthen bank alternative assembly embodiment, as shown in FIG. 6 and seen along the line 8—8 thereof.

As shown in FIGS. 6 and 8, a modular support frame base 30 as previously described in structure and assembly serves as the foundation platform upon which the remainder of the sloped earthen bank shoring system is erected. Once the modular support frame base 30 is assembled and positioned at the pit wall working face 72 as illustrated in FIG. 8, then a set of vertical frame posts 44 are insertably installed within the corresponding pit wall face post connecting sleeves 32 and retainably secured therewithin by means of insertable connection with connecting pins 36 through sleeve and post cooperatively aligned pin openings 38. Thereafter, upwardly disposed connecting pins 36 are inserted through the lowermost disposed vertical frame post 44 upward pin openings 38 to thereby serve as support stops for the upper lateral beam 50 upon which in turn is assembled the angled support beam upper connecting flange 80 by means of the post slot 82 therein receivably engaging the vertical frame post 44 with the upper connecting flange slot ears 84 being supported upon the top surface of the upper lateral beam 50 as shown in greater detail in the enlarged top plan view of FIG. 7.

Figure 9:
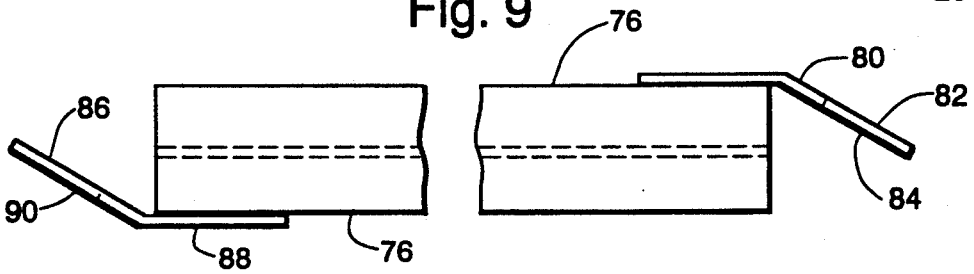
FIG. 9 is an enlarged side elevation view of an angled support beam employed in the modular supporting frame of the excavation shoring system sloped earthen bank alternative assembly embodiment, being foreshortened to accommodate the view to the sheet.
Figure 10:
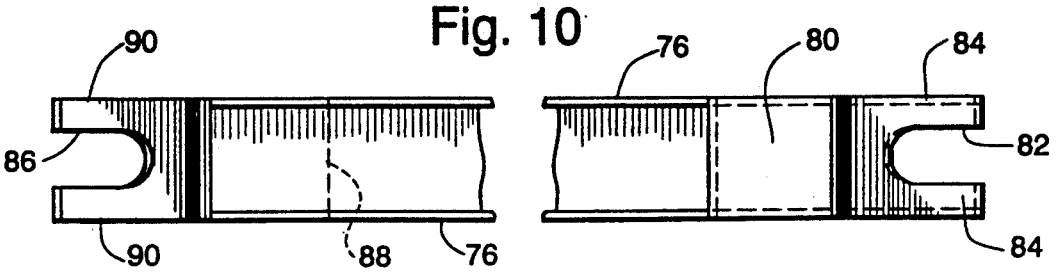
FIG. 10 is a corresponding top plan view of the angled support beam as shown in FIG. 9.

Next, the rearward disposed lower lateral beam 28 of the modular support frame base 30 is removed and the respective angled support beams 76 are rotatably aligned about the post slot pivots to bring the base post slot 86 of the angled support beam lower connecting flange 88 of each such beams 76 into receivable aligned engagement with the corresponding upward projecting base posts 22 so that the lower connecting flange slot ears 90 respectively thereof supportably rest upon the lower longitudinal beams 26 and are then compressively secured in retained position thereupon by re-assembly of the rearward disposed lower lateral beam 28 as respectively shown in FIGS. 6 and 8. Structural detail of an angled support beam 76 with the respective upper and lower connecting flanges 80 and 88 assembled thereto is as shown in FIGS. 9 and 10.

Finally, also as shown in FIGS. 6 and 8, shoring grids 52 with shoring planks 60 as appropriate and necessary are installed to provide pit side wall 92 support. Again, as with use employment of the previously described excavation shoring system 12, the pit wall working face 72 in use of the sloped earthen bank shoring system 74 is also shored to likewise provide facilitated excavation and boring equipment access thereto with safety from working face 72 cave in hazard.

Although the excavation shoring system and the sloped earthen bank shoring system alternate embodiment thereof, as well as the respective structural characteristics and methods of assembly and use employment thereof, have been shown and described in what are conceived to be the most practical and preferred embodiments, it is recognized that departures may be made respectively therefrom within the scope of the invention, which is not to be limited per se to those specific details as described herein but is to be accorded the full scope of the claims so as to embrace any and all equivalent such devices, apparatus, and methods.

We claim:

1. An excavation shoring system comprising in combination a modular support frame assembly having a plurality of interconnected longitudinal and lateral beam members said longitudinal beam members respectively provided with a cable connecting eye bolt centrally intermediate the ends thereof for ease of lifting for installation within an excavation depression at a use installation site wherein vertically displaced assembly of a second plurality of interconnected longitudinal and lateral beam members upon a plurality of vertical frame posts in turn respectively having a regularly spaced plurality of vertically aligned pin openings respectively adapted to insertably receive a connecting pin cooperatively installed within corresponding pin openings within said vertical frame posts to retain said vertically displaced assembly of said second plurality of interconnected longitudinal and lateral beam members at a uniform vertically disposed position upon said vertical frame posts and thereby provide a vertical support profile for said modular support frame assembly whereby a plurality of shoring grids are supportable leaned against the sides thereof when erectably installed within said excavation depression, said shoring grids comprising the plurality thereof in turn being provided with a successive plurality of shoring grid elongated pockets respectively adapted to slidably receive and support a shoring plank to provide additional excavation depression shoring support and thereby further in turn provide worker and equipment safety from excavation depression wall cave in hazard.

2. An excavation shoring system, said system comprising in combination a rectangular shaped modular support frame base having a plurality of interconnected longitudinal and lateral beam members, means upwardly supporting a vertical frame post at each corner of said rectangular shaped modular support frame base, a pin means insertably installed within a pin opening at an equal elevation in each of said vertical frame posts, a set of upper longitudinal beams insertably installed through a collar plate opening at the opposing ends respectively thereof upon said vertical frame posts stoppably against said pin means at said equal elevation and at parallelly disposed lateral spacing one from the other, a set of upper lateral beams insertably installed through a collar plate opening at the opposing ends thereof upon said upper longitudinal beams at parallelly disposed longitudinal spacing to thereby form a modular support frame assembly, and at least one shoring grid vertically supported against at least one side of said modular support frame assembly whereby safety from excavation depression wall cave in hazard is provided when erectably installed within an excavation depression at a use installation site.

3. An excavation shoring system according to claim 2 wherein said shoring grid in turn is provided with a vertically disposed successive plurality of shoring grid elongated pockets respectively adapted to slidably receive and support a shoring plank to provided additional excavation depression wall shoring support.

4. An excavation shoring system according to claim 2 wherein each of said vertical frame posts is respectively provided with a regularly spaced plurality of vertically aligned openings.

5. A sloped earthen bank shoring system, said system comprising in combination a rectangular shaped modular support frame base having a plurality of interconnected longitudinal and lateral beam members, means upwardly supporting a laterally spaced set of vertical frame posts positioned at the corners at one longitudinal end of said rectangular shaped modular support frame base, a pin means insertably installed within a pin opening at an equal elevation in each of said vertical frame posts, a laterally spaced set of upward projecting base posts positioned at the corners at the other longitudinal end of said rectangular shaped modular support frame base, a lateral beam insertably installed through a collar plate opening at the opposing ends respectively thereof upon said vertical frame posts stoppably against said pin means at said equal elevation, a parallelly spaced set of angled support beams respectively angularly interconnecting one of said vertical frame posts upwardly of said lateral beam at said one longitudinal end of said rectangular shaped modular support frame base to one of said upward projecting base posts at the other longitudinal end thereof to thereby form a spaced parallel set of triangular shaped support frames, and at least one shoring grid vertically supported against at least one of said triangular shaped support frames.

6. A sloped earthen bank shoring system according to claim 5 wherein each of said vertical frame posts is respectively provided with a regularly spaced plurality of vertically aligned pin openings.

7. A sloped earthen bank shoring system according to claim 5 wherein said shoring grid in turn is provided with a vertically disposed successive plurality of shoring grid elongated pockets respectively adapted to slidably receive and support a shoring plank to provide additional excavation depression wall shoring support.

* * * * *